US005580160A

United States Patent [19]

Schuler

[11] Patent Number: 5,580,160

[45] Date of Patent: Dec. 3, 1996

[54] ORNAMENT LIGHT FRAME

[75] Inventor: William J. Schuler, 43 Toelsin Rd., Cheektowaga, N.Y. 14225

[73] Assignee: William J. Schuler, Cheektowaga, N.Y.

[21] Appl. No.: 571,747

[22] Filed: Dec. 13, 1995

[51] Int. Cl.[6] ..... F21V 21/00

[52] U.S. Cl. ..... 362/249; 362/252; 362/391

[58] Field of Search ..... 362/249, 252, 362/391

[56] References Cited

U.S. PATENT DOCUMENTS

| | | | |
|---|---|---|---|
| 3,275,818 | 9/1966 | Campbell | 362/249 |
| 4,852,832 | 8/1989 | Delaney | 362/391 |
| 4,995,181 | 2/1991 | Wolf | 362/252 |

*Primary Examiner*—Carroll B. Dority

[57] ABSTRACT

A frame type structure consisting of angular cross sectional extrusions of polymer plastic pieces, their lengths being joined in linear or orthogonal series to form a rectangular or square shaped assembly. The assembled frame receives and holds holiday ornament lights in special slots all along the inner perimeter of the frame assembly. The frame is held in place during use by means of a friction fit between itself and the house opening, such as a window area, or if so desired or circumstance dictates, it may be fastened by means of screws to any appropriate mounting surface on a house such as window or door trim. The entire assembly may be left assembled to the house all year long or all of it or portions of it may be removed for storage after a holiday season.

1 Claim, 2 Drawing Sheets

ORNAMENT LIGHT FRAME

FIELD OF INVENTION

This invention relates to static structures with implements or hand held holder for a source of illumination, and more specifically to a static structure holder for holiday ornamental lights used in window areas of a house.

BACKGROUND—DISCUSSION OF PRIOR ART

Heretofore, prior art has consisted a very wide variety of mounting clips which accept and hold an ornamental light which is then mounted or otherwise fastened to some outer portion of a house, such as soffit or facia boards in a cornice area where the roof meets the sides of a house. Each of the mounting clips have to be separately fastened to the house using nails or screws. They are then a permanent feature on the outer house structure. Other prior art includes a rail-type member which is permanently mounted to the same portions of the house as described above, but mounting clips are added to the rail member anywhere along its length allowing for adjustment of spacing between lights. The lights and clips can be removed and stored separately. Another version of the rail-type member concept allows for the rail to be pivoted by a hinge and swung out of sight along with the lights mounted to it, when they are not in use or during the non-holiday season. My invention precludes the use of fasteners to hold it together and for mounting it to adjacent surfaces during use. Unlike the prior art my invention will mount for use using only friction, although fasteners may be used if desired, and my invention does not make use of a multitude of separate pieces such as the mounting clips.

OBJECTS AND ADVANTAGES

Accordingly I claim the following objects and advantages of my invention: to provide an ornament light holder which may be adapted to fit any size window, quickly and easily; to provide an ornament light holder which uses no fasteners for assembly nor for mounting within a window, door, or other opening; to provide an ornament light holder which is made primarily from an extruded plastic polymer material having no separate removable clips for holding and positioning the individual lights; to provide an ornament light holder which is will not corrode nor require painting; to provide an ornament light holder which may be easily removed from the window or other area of decoration and then stored without removing the light string from the holder. Other objects and advantages will become apparent from the embodiment described herein.

LIST OF REFERENCE NUMERALS

10(*a* and *b*) frame extrusion
12 extension adaptor
14 corner clip
16 fastener holes
18 light slots

DESCRIPTION

Figure 1:
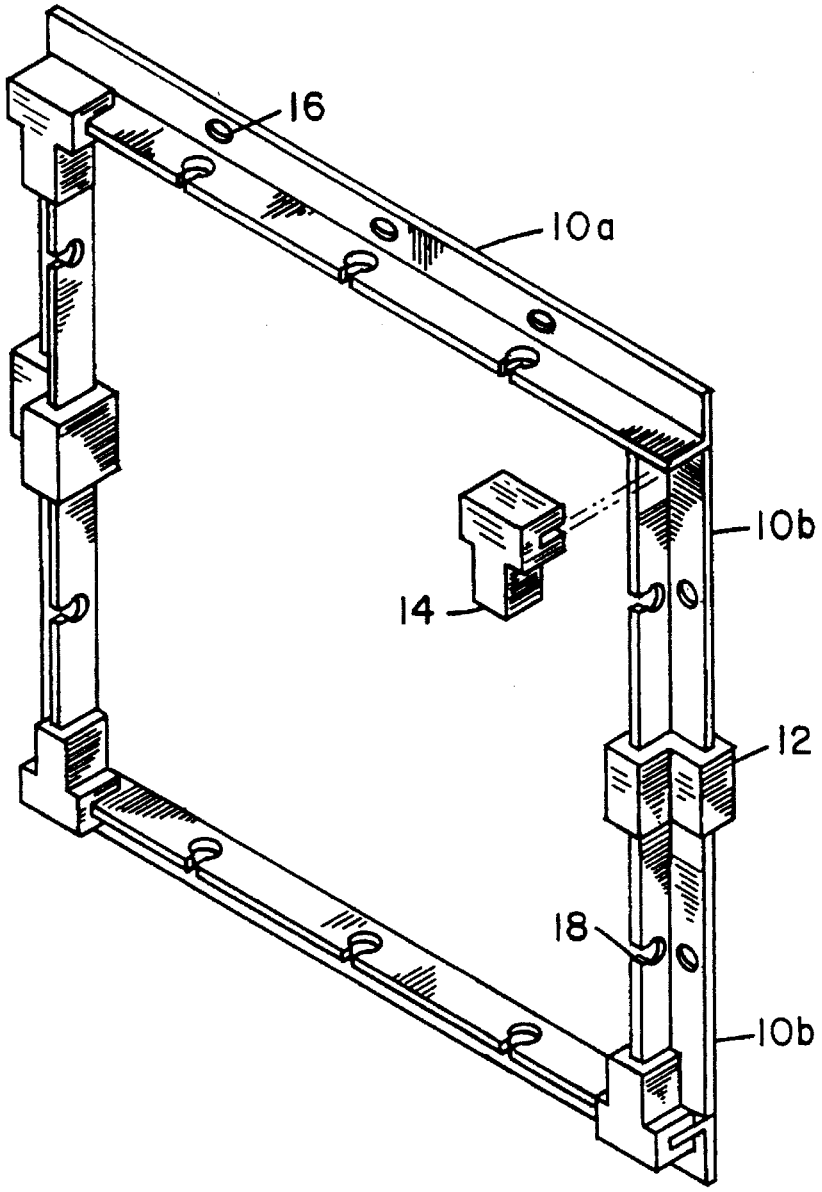
FIG. 1 shows a pictorial view of the frame assembly.
Figure 2:
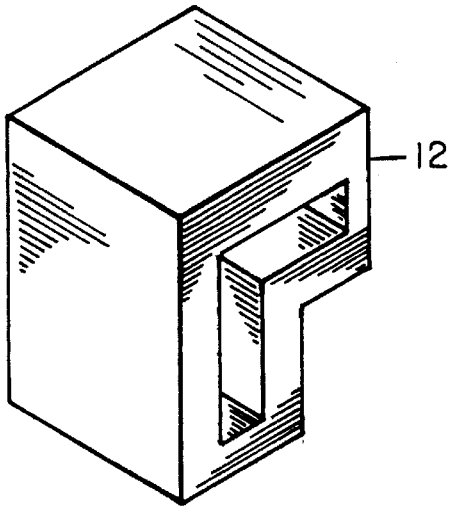
FIG. 2 shows a pictorial view of a extension adaptor used to join lengths of frame extrusion.
Figure 3:
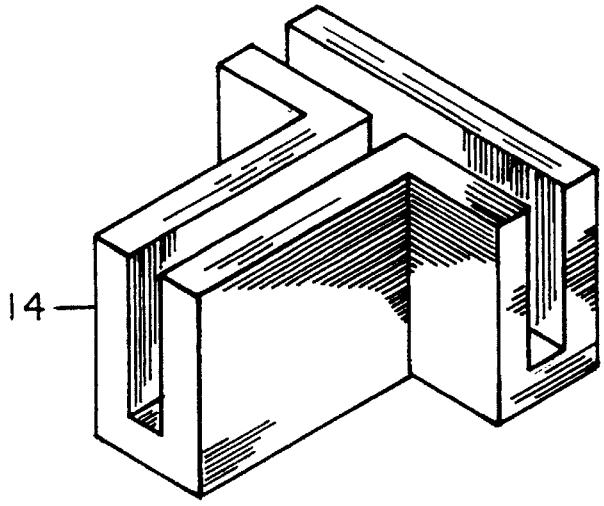
FIG. 3 shows a pictorial view of corner clips used to join and change direction of frame extrusions.

Referring to FIG. 1, there is shown a pictorial view of my invention where frame extrusions (10*a*) are joined in linear series by extension adaptors (12). Frame extrusions (10 *a* and *b*) are joined in orthogonal series by corner clips (14) to form right angles between frame extrusion members. As shown in FIG. 1, frame extrusions, extension adaptors, and corner clips are joined in continuous series to form a rectangular or square shaped assembly. Corner clips, and extension adaptors are joined to individual frame extrusions by means of mating slots, best shown in FIGS. 2 and 3, which fit over one leg of each frame extension's 90 degree angle shaped cross section. They are held in place by means of a tight friction fit thereby producing an overall rigid assembly.

OPERATION

The entire assembly as described above herein, is made up of frame extrusions, extension adaptors, and corner clips in such a rectangular or square shaped fashion by the user so as to fit snugly, by means of friction between itself and adjacent touching surfaces, into the intended opening or mounting surface on the user's house. Having assembled the pieces as described herein, the assembly is then placed with fastener holes (16) facing the house surfaces which are intended to captivate and hold the assembly in place by means of a friction fit. If the user so desires or their application dictates the need for other than a snug friction fit as a means for holding the ornament light fixture in place, wood screws or sheet metal screws (not shown and not a part of this invention) may be inserted into and through the mounting holes all around the frame, and may then be screwed into the mounting surface thereby securing it in place. A string of ornamental lights (not shown and not a part of this invention) are assembled to the mounted frame by placing the one bulb or bulb socket into each light slot (18) in a continuous series fashion all around the mounted frame.

Afterward, the plug to the string of ornamental lights is plugged into an electrical power source thereby energizing and illuminating the light bulbs. Disassembly is the reverse procedure described above. The lights may be left attached or assembled to the frame, or they may be removed before the frame is unscrewed from the mounting surface and stored away. The entire assembly, with or without the lights, may however be left mounted to the house all year depending upon the user's preference.

I claim:

1. An ornament light frame comprising:

a) a plurality of polymer extrusions each having a cross section comprising two legs at right angles to one another, b) an interconnection means for attaching said polymer extrusions end to end in a linear series relationship, c) an interconnection means for attaching said polymer extrusions end to end in an orthogonal series relationship, d) said polymer extrusions each having a plurality of circular voids through one leg of its cross section of sufficient size for screw type fasteners to pass, e) said polymer extrusions each having a plurality of U shaped voids through one leg of its cross section which has no circular voids.

* * * * *